US005599174A

United States Patent [19]

Cook et al.

[11] Patent Number: 5,599,174

[45] Date of Patent: Feb. 4, 1997

[54] DIAPHRAGM PUMP WITH MAGNETIC ACTUATOR

[75] Inventors: Stephen J. Cook, Berkshire; Richard E. Clark, Sheffield, both of United Kingdom

[73] Assignee: Huntleigh Technology plc., Luton, United Kingdom

[21] Appl. No.: 569,198

[22] PCT Filed: May 18, 1995

[86] PCT No.: PCT/GB95/01123

§ 371 Date: Jan. 16, 1996

§ 102(e) Date: Jan. 16, 1996

[87] PCT Pub. No.: WO95/31642

PCT Pub. Date: Nov. 23, 1995

[30] Foreign Application Priority Data

May 18, 1994 [GB] United Kingdom ..... 9409989

[51] Int. Cl.[6] ..... F04B 43/04

[52] U.S. Cl. ..... 417/413.1; 310/17

[58] Field of Search ..... 417/413.1, 413.2; 310/15, 17; 335/229

[56] References Cited

U.S. PATENT DOCUMENTS

| | | | |
|---|---|---|---|
| 3,572,980 | 3/1971 | Hollyday | 417/413.1 |
| 4,533,890 | 8/1985 | Patel . | |
| 4,786,240 | 11/1988 | Koroly et al. | 417/413.1 |
| 5,011,380 | 4/1991 | Kovacs | 417/413.1 |

FOREIGN PATENT DOCUMENTS

| | | | |
|---|---|---|---|
| 0162164 | 11/1985 | European Pat. Off. . | |
| 0409996 | 1/1991 | European Pat. Off. . | |
| 2324900 | 4/1977 | France | 417/413.1 |
| 143650 | 9/1980 | Germany | 417/413.1 |
| 4118628 | 12/1992 | Germany | 417/413.1 |
| 2079381 | 1/1982 | United Kingdom | 417/413.1 |

*Primary Examiner*—Timothy Thorpe
*Assistant Examiner*—Roland G. McAndrews, Jr.
*Attorney, Agent, or Firm*—Fitzpatrick, Cella, Harper & Scinto

[57] ABSTRACT

A diaphragm pump has a magnetic actuator. A permanent magnetic assembly is secured to the outside face of the diaphragm of the pump and provides at least a pair of opposed magnetic pole faces directed away from the diaphragm. An electromagnet assembly has at least a pair of opposite poles located opposite but spaced from the pole faces of the permanent magnet assembly. Energizing the electromagnet with alternating current, alternately repels and attracts the permanent magnet assembly, thereby reciprocating the diaphragm to operate the pump.

10 Claims, 1 Drawing Sheet

DIAPHRAGM PUMP WITH MAGNETIC ACTUATOR

The present invention relates to a diaphragm pump with a magnetic actuator.

Magnetic actuators for diaphragm pumps are known and operate by interaction between a magnetic field and electric current flowing in one or more coils or windings. Typically magnetic actuators include an electromagnet incorporating a fixed core and a winding associated with the core, influencing a movable armature also of soft ferromagnetic material. The armature is connected to the diaphragm. It is also known to include one or more permanent magnets mounted on a movable actuator member connected to the diaphragm, with the permanent magnets influenced by an electromagnet. In GB-A-2095766, a single permanent magnet is shown mounted directly on the diaphragm of a diaphragm pump.

Generally, designs known hitherto are intended for low power applications such as aerators for aquariums and little attention has been given to ensuring good magnetic and electrical efficiency.

The present invention provides a diaphragm pump comprising a housing, a diaphragm mounted in the housing for a reciprocating motion in a predetermined direction, the housing and the diaphragm enclosing a pumping chamber so that the diaphragm has inner and outer surfaces relative to the pumping chamber, a permanent magnet assembly secured to the outer surface of the diaphragm for movement therewith, the magnet assembly providing at least a pair of opposed magnetic poles, having all the pole faces of the assembly being adjacent one another and directed away from the outer surface of the diaphragm so as to extend transversely of said predetermined direction of motion of the diaphragm, and an electromagnet assembly having at least a pair of opposite poles located opposite but spaced in said direction of motion from said pole faces of said pair of poles of the permanent magnet assembly.

Preferably, said permanent magnet assembly comprises respective permanent magnets for each of said opposed magnetic poles, one pole of each said permanent magnet providing a respective one of said pole faces directed away from the diaphragm and the other poles of said permanent magnets being directed towards the diaphragm, and at least one soft ferromagnetic back iron member interlinking said other poles of the permanent magnet. With this back iron member, the only effective poles of the complete magnet assembly are those facing away from the diaphragm.

Typically, each of said permanent magnets is formed as a separate piece of magnetisable material. However, it is also possible to form the permanent magnets as separately magnetised parts of a unitary piece of magnetisable material.

Said back iron member can be secured between said permanent magnets and the diaphragm. In preferred arrangements, the thickness of the permanent magnet assembly in said predetermined direction of motion is less than the dimensions of each pole face transverse to said direction.

In a preferred embodiment, the permanent magnet assembly has circular symmetry about an axis in said direction of motion providing one pair of poles comprising an inner central pole and an outer annular pole, and the electromagnet assembly has corresponding circular symmetry.

In another arrangement, the permanent magnet assembly comprises an array of poles of alternating polarity and the electromagnet simply has a corresponding array of alternate poles. Conveniently said arrays are circular.

Conveniently, the electromagnet assembly may comprise a central core element, a single coil wound on said central core element, a star shaped core piece at one end of the central core element having radial arms forming the poles of one polarity in the array, and folded core pieces extending from the other end of the central core element round the coil to lie between the arms of the star shaped core piece and form the poles of the other polarity in the array.

Examples of the present invention will now be described with reference to the accompanying drawings in which.

Figure 1:
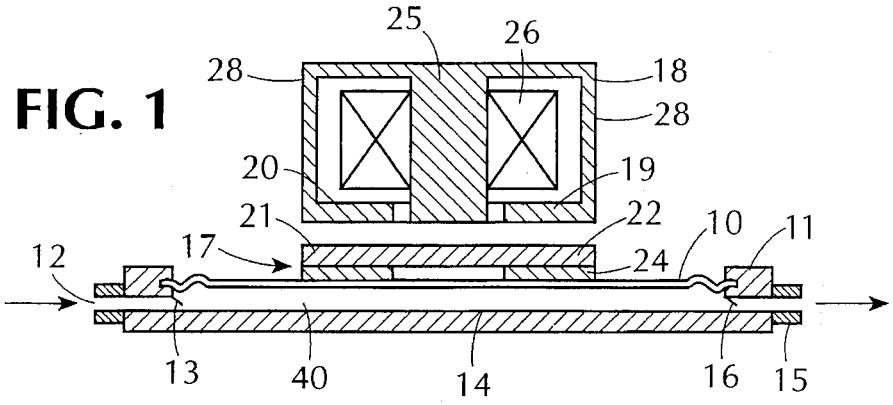
FIG. 1 is a cross sectional schematic view of a diaphragm pump incorporating a diaphragm actuator embodying the present invention.

Referring to FIG. 1, a diaphragm pump comprises a flexible diaphragm 10 mounted in a housing 11 for reciprocating motion in a direction normal to the plane of the diaphragm 10 as illustrated. The diaphragm 10 and housing 11 enclose a pumping chamber 40. Movement of the diaphragm 10 upwards in FIG. 1 draws air into the chamber 40 through an inlet 12 via a one way valve 13 and movement of the diaphragm 10 downwards in FIG. 1 towards a back wall 14 of the housing 11, forces air out of the chamber 40 through an outlet 15 via a one way valve 16. The diaphragm 10 is moved by means of a magnetic actuator comprising a permanent magnet assembly 17 mounted on the outer surface of the diaphragm 10 and an electromagnet assembly 18 which is mounted by structural means not shown in the drawing so as to be stationary relative to the housing 11.

As illustrated, the electromagnet assembly 18 is mounted so as to have poles 19, 20 located immediately opposite but spaced from corresponding poles 21, 22 of the permanent magnet assembly 17. The electromagnet is energised by a coil winding 26.

Figure 2:
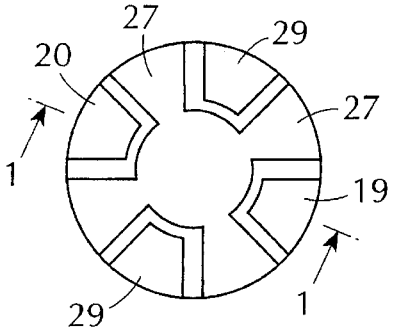
FIGS. 2 and 3 are plan views illustrating the layout of the poles of the electromagnet and the permanent magnets respectively in the embodiment of FIG. 1.
Figure 3:
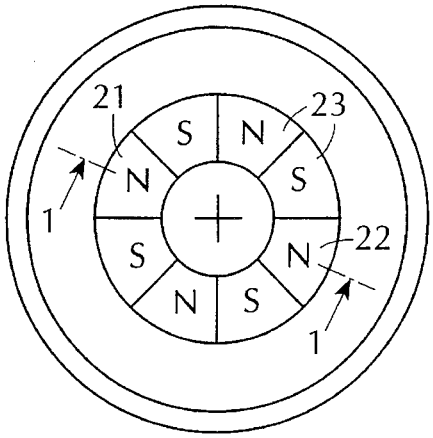

Referring now to FIGS. 2 and 3, the arrangement of the poles of the electromagnet assembly 18 and the permanent assembly 17 is illustrated. Considering firstly FIG. 3, the permanent magnet assembly 17 provides an array of alternating North and South poles around an annulus as illustrated. The section for the view of the permanent magnet assembly in FIG. 1 is taken along line 1—1 in FIG. 3. It can be seen, therefore, that both poles 21 and 22 of the permanent magnet assembly are North poles.

The permanent magnet assembly is formed from eight individual plate like permanent magnet elements 23 each shaped as a sector of an annulus and having opposed magnetic poles on opposite larger faces. The elements 23 are arranged in alternating polarity, so that the facing poles in FIG. 3 (the upper poles in FIG. 1) form a circular array of alternating poles.

Bonded between the magnet elements 23 and the diaphragm 10, there is a thin annular element 24 (FIG. 1) of soft iron, providing back iron for the permanent magnet elements 23. The thickness of the back iron annulus 24 is dependent on the spacing along the circular array between the centres of the permanent magnet elements 23. Thus, the more permanent magnet elements 23 forming the circular array, the thinner can be the back iron annulus 24. It can be seen that the facing poles in FIG. 3 are the only effective poles of the complete magnet assembly as the other poles of the magnet elements 23 are shunted by the soft iron element 24.

The electromagnet assembly 18 is arranged to provide alternating poles registering with the upwardly facing poles 21, 22 of the permanent magnet elements 23. Referring to FIG. 2, the section of the electromagnet assembly 18 shown in FIG. 1 is taken along the line 1—1. The electromagnet assembly 18 comprises a central soft iron core element 25 which is encircled by a coil 26. The lower end (as shown in FIG. 1) of the central core element 25 is formed with a generally star shaped extension providing four arms 27 (FIG. 2). These arms 27 overlie and face the South poles of the permanent magnet elements 23. From the opposite, upper end (in FIG. 1) of the central core element 25 there are provided four folded core pieces extending radially outwardly from the central member 25 and then downwards outside the coil 26 with radially inwardly extending portions beneath the coil 26 to form the poles 19 and 20 (FIGS. 1 and 2). As can be seen from FIG. 2, the folded core elements extend at the lower face of the electromagnet between the arms 27 of the star shaped core piece. It can be seen, therefore, that on energising the electromagnet with a current flowing in the coil 26, the pole pieces 19 and 20 of the electromagnet are of opposite polarity to the pole pieces formed by the arms 27. The pole pieces 19 20, and the equivalent pieces 29 accordingly form between them a circular array of alternate poles, which are aligned so as to register with the alternating polarity poles of the permanent magnet assembly.

Energising the electromagnet assembly 28 with alternating current flowing in the coil 26 will cause the permanent magnet assembly 17 and the diaphragm bonded thereto to be alternately attracted and repelled from the electromagnetic assembly, thereby applying a reciprocating motion to the diaphragm.

The core and pole structure for the electromagnet assembly 18 as described above with reference to FIGS. 1 and 2 is especially suitable when the actuator is to be energised directly from mains electricity. Then, the coil 26 must have a considerable number of turns in order to provide the required impedance and a structure for the assembly 18 as illustrated can accommodate the volume of windings required.

Figure 4:
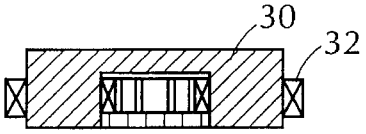
FIGS. 4 and 5 illustrate in cross sectional view and plan view respectively an alternative embodiment of electromagnet.
Figure 5:
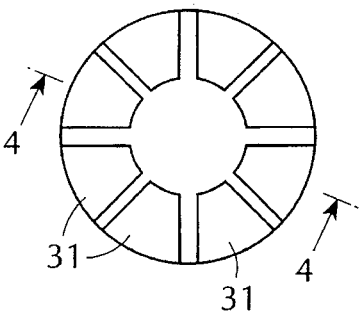

An alternative structure for the electromagnet assembly 18 is illustrated in FIGS. 4 and 5. Here, the section of FIG. 4 is taken along line 4—4 of FIG. 5. The electromagnet illustrated has a soft iron core comprising a disc shaped yoke element carrying eight axial extensions 31 around the periphery of the yoke. Each of the axial extensions 31 is formed as a sector of an annulus with spaces between each extension 31 to accommodate windings round each extension 31 to energise the electromagnet. The windings round neighbouring extensions 31 are in the opposite sense so that when all the windings are energised, e.g. in series, from a common supply, the radial faces of the extensions 31 then constitute alternating magnetic poles arranged in a circular array. The magnetic poles provided by the extensions 31 correspond to the poles 27 and 29 described above with reference to FIG. 2, and the electromagnet is arranged so that these poles register with the alternating permanent magnet poles bonded to the diaphragm.

Figure 6:
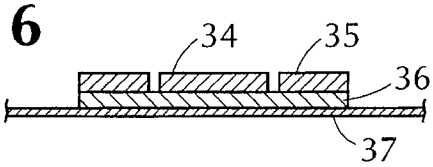
FIGS. 6 and 7 are cross sectional and plan views respectively of an alternative embodiment of permanent magnet assembly.
Figure 7:
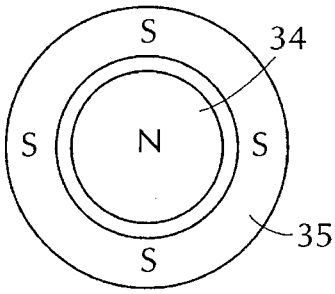

Although the examples described above both have a total of eight alternate poles in each of the permanent magnet assembly and the electromagnet assembly, arrangements with fewer numbers of poles are also contemplated. In particular, FIGS. 6 and 7 illustrate an arrangement with only a central circular pole and an outer annular pole of opposite polarity. FIGS. 6 and 7 illustrate the structure of the permanent magnet having this arrangement. The permanent magnet assembly is then formed of a central permanent magnet element 34 shaped as a thin disc magnetised axially so that the larger faces of the disc constitute opposite pole faces. Surrounding the disc element 34 is a second annular permanent magnet element 35 which is also magnetised axially. The two elements 34 and 35 are bonded with opposed polarity to a disc shaped soft iron backing member 36 which is in turn bonded to the diaphragm 37. As illustrated in FIG. 7, an annular space is provided between the outer circumference of the central element 34 and the inner circumference of the annular element 35.

The permanent magnet arrangement of FIG. 6, may be used with an electromagnet having a central core element on which is mounted the energising coil and an outer shell element extending from one end of the central core around the outside of the coil and radially inwards at the opposite end of the coil towards the opposite end of the central element. The resulting structure appears in cross section similar to that illustrated in FIG. 1, but having a plan view, not like that shown in FIG. 2, but substantially like the plan view of the permanent magnet assembly as shown in FIG. 7.

Figure 8:
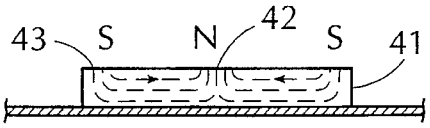
FIG. 8 is a cross sectional view of another embodiment of the permanent magnet assembly.

It will be appreciated that, in the above examples, the soft iron backing member or element between the permanent magnet elements and the diaphragm must be of sufficient cross section to accommodate the full magnetic flux between adjacent magnet elements of the assembly without saturating. By increasing the member of alternating magnetic poles in the magnet assembly, e.g. in the circular array arrangement of FIG. 3, the amount of flux linking adjacent poles through the backing member can be reduced, whilst maintaining the same total flux from the upper pole faces of the assembly. As a result the thickness of the backing member may be reduced with a corresponding reduction in the reciprocating mass associated with the diaphragm. FIG. 8 illustrates a further embodiment of permanent magnet assembly which may allow a soft iron backing member to be dispensed with completely. In FIG. 8, the magnet assembly is formed of a one piece disc 41 of isotropic magnetic material secured to the diaphragm 44 and formed as a "self shielding" magnet, which is magnetised to provide a central pole 42 of one polarity and an outer annular pole 43 of the other polarity, all on the same outer face of the disc 41.

The examples of magnetic actuator described above can have a very low number of components resulting in the possibility of very low cost construction. Further, the only moving part is the composite component comprising the diaphragm itself and the permanent magnet assembly bonded thereto. It is also possible to make an entire diaphragm pump with magnetic actuator assembly with a relatively small dimension in the direction perpendicular to the diaphragm plane. As a result, diaphragm pumps can be made using these arrangements which are relatively thin in at least one dimension so that an entire pump may be incorporated for example in the walls of a pneumatic device to be inflated.

We claim:

1. A diaphragm pump comprising a housing, a diaphragm mounted in the housing for a reciprocating motion in a predetermined direction, the housing and the diaphragm enclosing a pumping chamber so that the diaphragm has inner and outer surfaces relative to the pumping chamber, a permanent magnet assembly secured to the outer surface of the diaphragm for movement therewith, the magnet assembly providing at least a pair of opposed magnetic poles, having all the pole faces of the assembly being adjacent one another and directed away from the outer surface of the diaphragm so as to extend transversely of said predetermined direction of motion of the diaphragm, and an electromagnet assembly having at least a pair of opposite poles located opposite but spaced in said direction of motion from said pole faces of said pair of poles of the permanent magnet assembly.

2. A diaphragm pump as claimed in claim 1, wherein said permanent magnet assembly comprises respective permanent magnets for each of said opposed magnetic poles, one pole of each said permanent magnet providing a respective one of said pole faces directed away from the diaphragm and the other poles of said permanent magnets being directed towards the diaphragm, and at least one soft ferromagnetic back iron member interlinking said other poles of the permanent magnets.

3. A diaphragm pump as claimed in claim 2, wherein each of said permanent magnets is formed as a separate piece of magnetisable material.

4. A diaphragm pump as claimed in claim 2, wherein said permanent magnets are formed as separately magnetised parts of a unitary piece of magnetisable material.

5. A diaphragm pump as claimed in any of claims 2 to 4 wherein said back iron member is secured between said permanent magnets and the diaphragm.

6. A diaphragm pump as claimed in any of claims 1–4, wherein the thickness of the permanent magnet assembly in said predetermined direction of motion is less than the dimensions of the pole face transverse to said direction.

7. A diaphragm pump as claimed in any of claims 1–4, wherein the permanent magnet assembly has circular symmetry about an axis in said direction of motion providing one pair of poles comprising an inner central pole and an outer annular pole, and the electromagnet assembly has corresponding circular symmetry.

8. A diaphragm pump as claimed in any of claims 1 to 4, wherein the permanent magnet assembly comprises an array of poles of alternating polarity and the electromagnet assembly has a corresponding array of alternate poles.

9. A diaphragm pump as claimed in claim 8, wherein said arrays are circular.

10. A diaphragm pump as claimed in claim 9, wherein the electromagnet assembly comprises a central core element, a single coil wound on said central core element, a star shaped core piece at one end of the central core element having radial arms forming the poles of one polarity in the array, and folded core pieces extending from the other end of the central core element around the coil to lie between the arms of the star shaped core piece and form the poles of the other polarity in the array.

* * * * *